US009002221B2

(12) United States Patent
Wakayama

(10) Patent No.: US 9,002,221 B2
(45) Date of Patent: Apr. 7, 2015

(54) CLEANING DEVICE FOR IMAGE CARRIER AND IMAGE FORMING APPARATUS INCLUDING CLEANING PORTION FOR IMAGE CARRIER

(71) Applicant: KYOCERA Document Solutions Inc., Osaka (JP)

(72) Inventor: Kei Wakayama, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 96 days.

(21) Appl. No.: 13/887,095

(22) Filed: May 3, 2013

(65) Prior Publication Data

US 2013/0315643 A1 Nov. 28, 2013

(30) Foreign Application Priority Data

May 24, 2012 (JP) ..... 2012-118415

(51) Int. Cl.
*G03G 21/00* (2006.01)

(52) U.S. Cl.
CPC ..... *G03G 21/0011* (2013.01); *G03G 21/0005* (2013.01); *G03G 21/0076* (2013.01)

(58) Field of Classification Search
CPC ..... G03G 21/0011; G03G 21/0058; G03G 21/007; G03G 21/0076; G03G 2221/001; G03G 2221/0089
USPC ..... 399/102, 349, 350, 357
See application file for complete search history.

(56) References Cited

U.S. PATENT DOCUMENTS

| | | | | |
|---|---|---|---|---|
| 4,982,239 | A | 1/1991 | Kume et al. | |
| 6,553,195 | B2 * | 4/2003 | Korfhage et al. | 399/102 |
| 8,244,156 | B2 * | 8/2012 | Iwamoto et al. | 399/123 |
| 2006/0204297 | A1 | 9/2006 | Honda et al. | |
| 2009/0269106 | A1 | 10/2009 | Fujii | |
| 2013/0016993 | A1 * | 1/2013 | Akamatsu | 399/102 |

FOREIGN PATENT DOCUMENTS

| | | | |
|---|---|---|---|
| EP | 1762904 | A2 | 3/2007 |
| JP | 59155877 | A | 9/1984 |
| JP | 07160168 | A * | 6/1995 |
| JP | 2000338777 | A | 12/2000 |
| JP | 2005164675 | A * | 6/2005 |
| JP | 2006251132 | A | 9/2006 |
| JP | 2009265299 | A | 11/2009 |
| JP | 2009265409 | A * | 11/2009 |

OTHER PUBLICATIONS

European Patent Office, Extended European Search Report of EP13167106.7, Dec. 13, 2013, Germany, 6 pages.

* cited by examiner

*Primary Examiner* — Robert Beatty
(74) *Attorney, Agent, or Firm* — Alleman Hall McCoy Russell & Tuttle LLP

(57) ABSTRACT

A cleaning device includes a cleaning portion and a pressing portion. The cleaning portion comes into contact with an image carrier that is adapted to carry a toner image. The pressing portion includes a clamping surface and a protruding portion and presses the cleaning portion against the image carrier. The clamping surface clamps the cleaning portion from both sides in cooperation with the image carrier. The protruding portion protrudes from the clamping surface toward the image carrier.

12 Claims, 9 Drawing Sheets

CLEANING DEVICE FOR IMAGE CARRIER AND IMAGE FORMING APPARATUS INCLUDING CLEANING PORTION FOR IMAGE CARRIER

INCORPORATION BY REFERENCE

This application is based upon and claims the benefit of priority from the corresponding Japanese Patent Application No. 2012-118415 filed on May 24, 2012, the entire contents of which are incorporated herein by reference.

BACKGROUND

The present disclosure relates to a cleaning device that cleans an image carrier that is adapted to carry a toner image, and an image forming apparatus including a cleaning portion for an image carrier.

An image forming apparatus that forms an image using toner includes a photosensitive drum that is adapted to carry a toner image, and a developing device including a developing roller that supplies toner to the photosensitive drum. It is desirable that an appropriate clearance is maintained between the photosensitive drum and the developing roller so that a high-quality toner image is formed.

The photosensitive drum includes a circumferential surface that receives the toner from the developing roller. The circumferential surface is broadly divided into an image formation region in which a toner image is formed and an adjacent region that is adjacent to the image formation region. In order to achieve uniform image formation by maintaining a constant distance (spacing) between the photosensitive drum and the developing roller, there are situations where the developing roller includes a gap ring (spacer roller) that abuts against the adjacent region.

If toner adheres to the adjacent region, the gap ring goes up onto the toner on the adjacent region. This results in a change in the clearance between the photosensitive drum and the developing roller. Therefore, it is necessary that the toner adhering to the adjacent region should be appropriately removed.

There also are situations where the image forming apparatus includes a cleaning device having a seal member and/or a blade member that is capable of removing the toner adhering to the adjacent region. The seal member wipes off the toner adhering to the adjacent region, so that an appropriate distance (spacing) between the photosensitive drum and the developing roller is maintained.

SUMMARY

A cleaning device according to one aspect of the present disclosure includes a cleaning portion and a pressing portion. The cleaning portion comes into contact with an image carrier that is adapted to carry a toner image. The pressing portion includes a clamping surface and a protruding portion and presses the cleaning portion against the image carrier. The clamping surface clamps the cleaning portion from both sides in cooperation with the image carrier. The protruding portion protrudes from the clamping surface toward the image carrier.

An image forming apparatus according to another aspect of the present disclosure includes an image carrier, a cleaning portion, and a pressing portion. The image carrier is adapted to carry a toner image. The cleaning portion comes into contact with the image carrier. The pressing portion includes a clamping surface and a protruding portion and presses the cleaning portion against the image carrier. The clamping surface clamps the cleaning portion from both sides in cooperation with the image carrier. The protruding portion protrudes from the clamping surface toward the image carrier.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Hereinafter, a cleaning device and an image forming apparatus will be described using the accompanying drawings. It should be noted that directional terms, such as "above", "below", "left", or "right", as used in the following description are only for the purpose of elucidating the description. Therefore, these terms do not at all limit the principles of the cleaning device and the image forming apparatus.

Image Forming Apparatus

Figure 1:
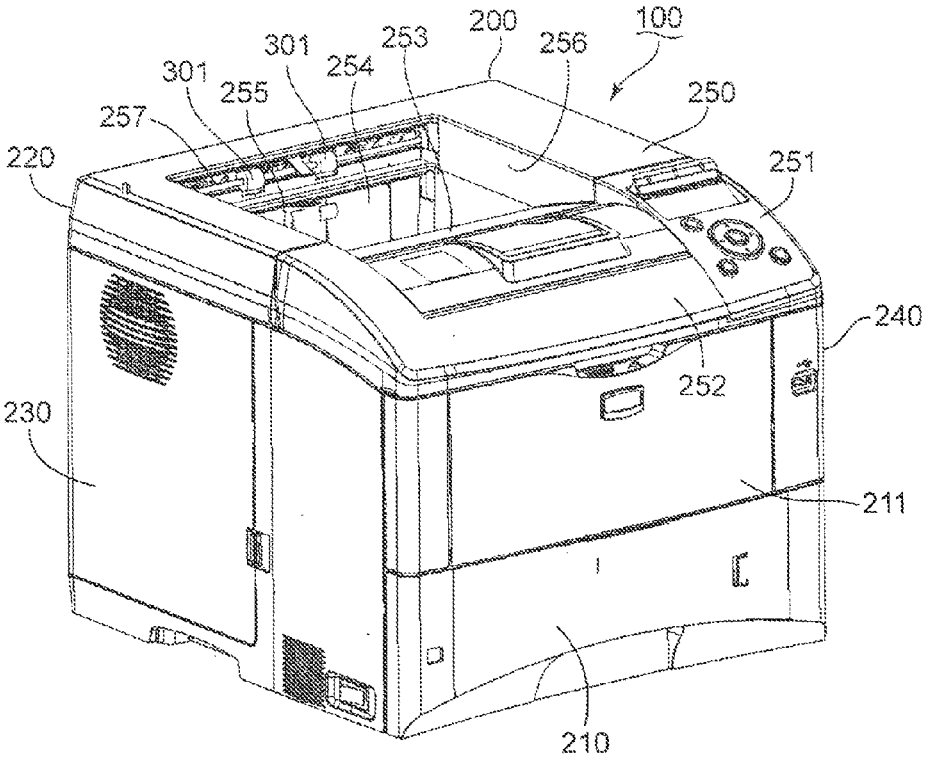
FIG. 1 is a schematic perspective view of a printer that is described as an example of an image forming apparatus according to an embodiment of the present invention.

FIG. 1 is a schematic perspective view showing a printer 100 which is described as an example of the image forming apparatus. The printer 100 will be described using FIG. 1. It should be noted that the image forming apparatus according to the present disclosure may also be another apparatus that forms images using toner, such as a copier, a facsimile machine, or a multifunction peripheral.

The printer 100 includes a main housing 200 that accommodates various devices (for example, a photosensitive drum, a developing device, or a toner container) that are used during formation of an image on a sheet. The main housing 200 includes a front wall portion 210 and a rear wall portion 220 on the opposite side to the front wall portion 210. The main housing 200 includes a left wall portion 230 that extends upright between the front wall portion 210 and the rear wall portion 220, and a right wall portion 240 on the opposite side to the left wall portion 230. The main housing 200 further includes an upper wall portion 250 that extends horizontally within a region surrounded by upper edges of the front wall portion 210, the rear wall portion 220, the left wall portion 230, and the right wall portion 240.

The upper wall portion 250 includes a console 251. A user can give various instructions to the printer 100 by using the console 251.

The upper wall portion 250 further includes a rotatable wall 252. The user can rotate the rotatable wall 252 upward and access the toner container and the like that are accommodated in the main housing 200 when necessary.

The upper wall portion 250 includes a stacker plate 253 that is disposed rearward of the rotatable wall 252, and a discharge wall 254 that extends upright from a rear end of the stacker plate 253. The upper wall portion 250 further includes a left inner wall 255 that extends upright from a left end of the stacker plate 253, and a right inner wall 256 that extends upright from a right end of the stacker plate 253. A discharge opening 257 is formed in the discharge wall 254. After the printing process in the main housing 200, the sheet is discharged onto the stacker plate 253 through the discharge opening 257. The stacker plate 253, the discharge wall 254, the left inner wall 255, and the right inner wall 256 form a recess. After the printing process, the sheet is stacked on the stacker plate 253 within the recess.

The printer 100 further includes discharge rollers 301 that are attached to the discharge opening 257. The discharge rollers 301 discharge the sheet after the printing process from the main housing 200. The discharged sheet is stacked on the stacker plate 253.

The front wall portion 210 includes a manual feed tray 211. The user can rotate the manual feed tray 211 forward when necessary. The user can then place a sheet on the manual feed tray 211. The sheet on the manual feed tray 211 is drawn into the inside of the main housing 200 and undergoes the printing process. After the printing process, the sheet is discharged from the main housing 200 by the discharge rollers 301.

Conveyance of Sheet in Main Housing

Figure 2:
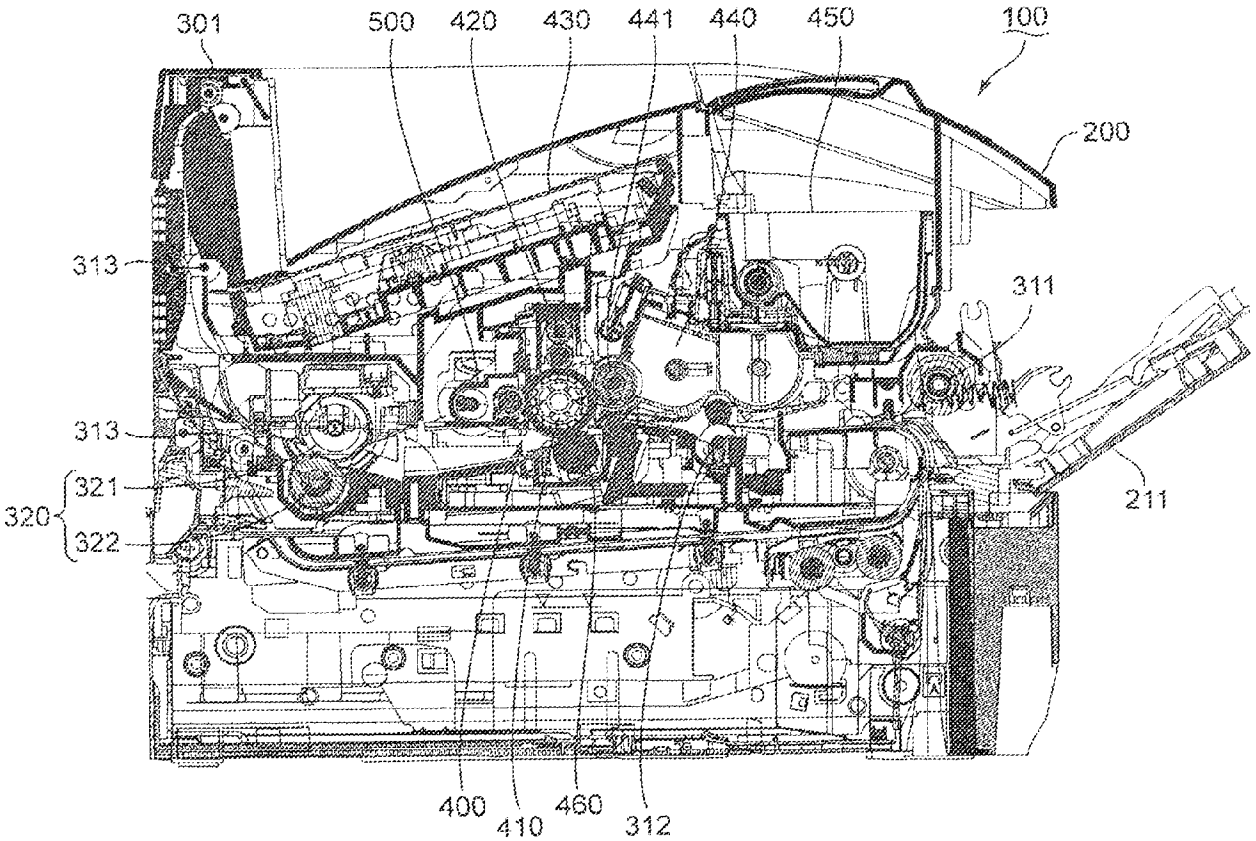
FIG. 2 is a schematic cross-sectional view of the printer shown in FIG. 1.

FIG. 2 is a schematic cross-sectional view of the printer 100. Conveyance of a sheet from the manual feed tray 211 to the discharge rollers 301 will be described using FIG. 2.

The printer 100 includes a paper feed roller 311 that draws a sheet placed on the manual feed tray 211 into the main housing 200. A paper feed structure that is constructed between the paper feed roller 311 and the manual feed tray 211 may be the same as the paper feed structure provided in a known printer.

The printer 100 includes an image forming portion 400 that forms a toner image, and a pair of registration rollers 312 that is disposed between the image forming portion 400 and the paper feed roller 311. The pair of registration rollers 312 feeds the sheet in synchronization with an image forming step of the image forming portion 400. As a result, the image forming portion 400 can transfer the toner image onto an appropriate portion of the sheet.

The printer 100 further includes a fixing device 320 that is disposed between the image forming portion 400 and the rear wall portion 220. The fixing device 320 includes a heat roller 321 and a pressure roller 322 that presses the sheet against the heat roller 321. The sheet onto which the toner image has been transferred from the image forming portion 400 passes between the heat roller 321 and the pressure roller 322. Meanwhile, the toner image on the sheet is pressed against the heat roller 321, and the toner is fused. As a result, the toner image is fixed on the sheet.

The printer 100 includes a plurality of pairs of conveyance rollers 313 that are disposed downstream of the fixing device 320. The plurality of pairs of conveyance rollers 313 are arranged along an upward extending path. The sheet on which the toner image has been fixed is conveyed upward by the plurality of pairs of conveyance rollers 313 and is finally discharged from the main housing 200 by the discharge rollers 301.

Image Forming Portion

The image forming portion 400 will be described using FIG. 2.

The image forming portion 400 includes a photosensitive drum 410 that has a circumferential surface on which a toner image is carried. In the present embodiment, the photosensitive drum 410 is described as an example of an image carrier that is adapted to carry a toner image.

The image forming portion 400 further includes a charger 420 that substantially uniformly charges the circumferential surface of the photosensitive drum 410. As a result of the charging process by the charger 420, the toner can be electrostatically adsorbed on the circumferential surface of the photosensitive drum 410.

The image forming portion 400 further includes an exposure device 430. The printer 100 is electrically connected to, for example, a personal computer (not shown). The personal computer outputs data regarding an image to be printed to the printer 100.

As the photosensitive drum 410 rotates, the charged circumferential surface of the photosensitive drum 410 reaches a position at which the circumferential surface is irradiated with a laser beam from the exposure device 430. The exposure device 430 emits a laser beam in accordance with the data output from the personal computer. As a result, an electrostatic latent image is formed on the circumferential surface of the photosensitive drum 410.

The image forming portion 400 further includes a developing device 440 that supplies toner to the circumferential surface of the photosensitive drum 410, and a toner container 450 that replenishes the developing device 440 with toner as appropriate. The developing device 440 includes a developing roller 441 that is slightly spaced apart from the photosensitive drum 410.

As the photosensitive drum 410 rotates, the circumferential surface of the photosensitive drum 410 on which the electrostatic latent image is formed moves to a position at which the toner is supplied thereto from the developing device 440. At this supply position, the toner is supplied to the photosensitive drum 410 via the developing roller 441. As a result, the electrostatic latent image is developed into a toner image.

The image forming portion 400 further includes a transfer roller 460 that attracts the toner image on the photosensitive drum 410 to the sheet. As the photosensitive drum 410 rotates, the circumferential surface of the photosensitive drum 410 that carries the toner image moves to a position at which transfer by the transfer roller 460 is performed. The pair of registration rollers 312 feeds the sheet into a gap between the photosensitive drum 410 and the transfer roller 460. When the sheet passes between the photosensitive drum 410 and the transfer roller 460, the toner image formed on the circumferential surface of the photosensitive drum 410 is transferred onto the sheet.

The image forming portion 400 further includes a cleaning device 500 that cleans the photosensitive drum 410. As the photosensitive drum 410 rotates, the circumferential surface of the photosensitive drum 410 from which the toner image has been transferred to the sheet moves to a cleaning position at which the cleaning device 500 removes the toner. The cleaning device 500 removes residual toner from the circumferential surface of the photosensitive drum 410.

Regions of Photosensitive Drum

Figure 3:
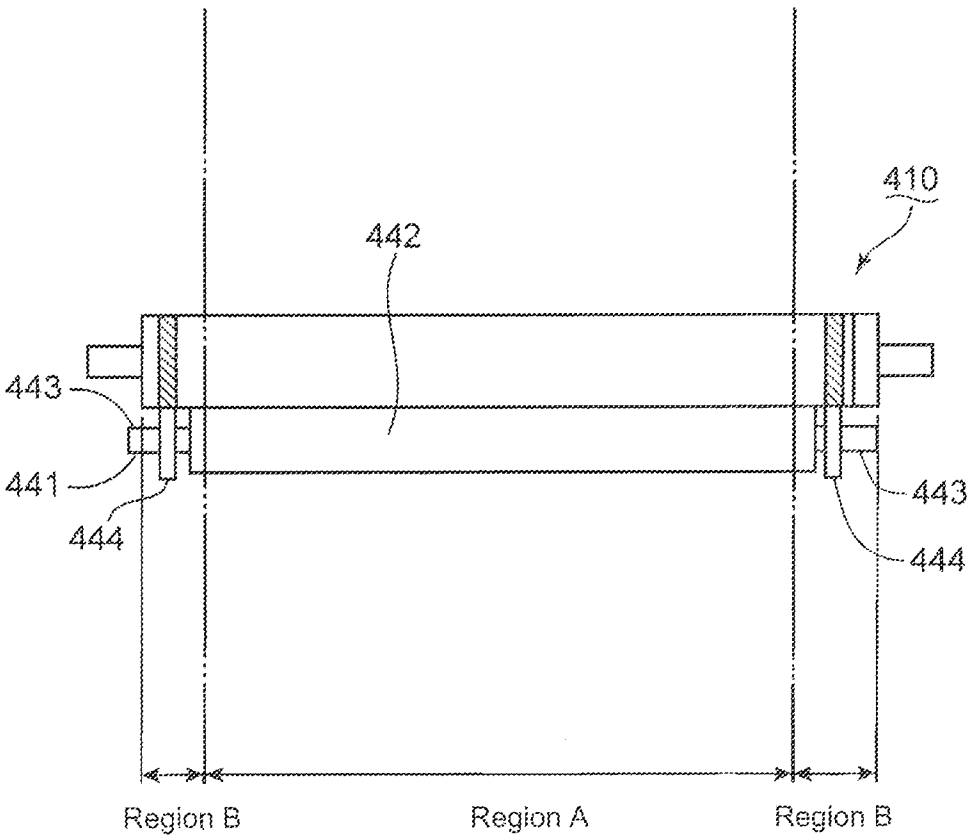
FIG. 3 is a schematic plan view of a photosensitive drum of the printer shown in FIG. 2.

FIG. 3 is a schematic plan view of the photosensitive drum 410. Regions of the photosensitive drum 410 will be described using FIGS. 2 and 3.

The circumferential surface of the photosensitive drum 410 is divided into a region A that is used to form a toner image and a pair of regions B that are located to the left and to the right, respectively, of the region A so as to be adjacent to the region A. The cleaning device 500 that has been described with reference to FIG. 2 is capable of appropriately removing residual toner adhering to the regions A and B.

The developing roller 441 includes a cylindrical supply portion 442 that can supply toner to the region A, and a pair of journals (shaft portions) 443 protruding from the respective ends of the supply portion 442. The developing roller 441 further includes gap rings 444 that are attached to the respective journals 443. The gap rings 444 have a larger diameter than the supply portion 442. Accordingly, a narrow gap is formed between the supply portion 442 and the photosensitive drum 410. The gap rings 444 are used to keep the distance between the supply portion 442 and the photosensitive drum 410 constant.

The gap rings 444 roll on the respective regions B. In FIG. 3, those regions with which the respective gap rings 444 come into contact are hatched. If a gap ring 444 goes up onto the toner adhering to the corresponding region B, the distance between the supply portion 442 and the photosensitive drum 410 changes. The change in the distance between the supply portion 442 and the photosensitive drum 410 may sometimes manifest itself as a change in the density of the toner image on the sheet. The cleaning device 500 that has been described with reference to FIG. 2 appropriately removes the toner adhering to the regions B. Thus, an appropriate positional relationship between the supply portion 442 and the photosensitive drum 410 is maintained.

Cleaning of Region A

Figure 4:
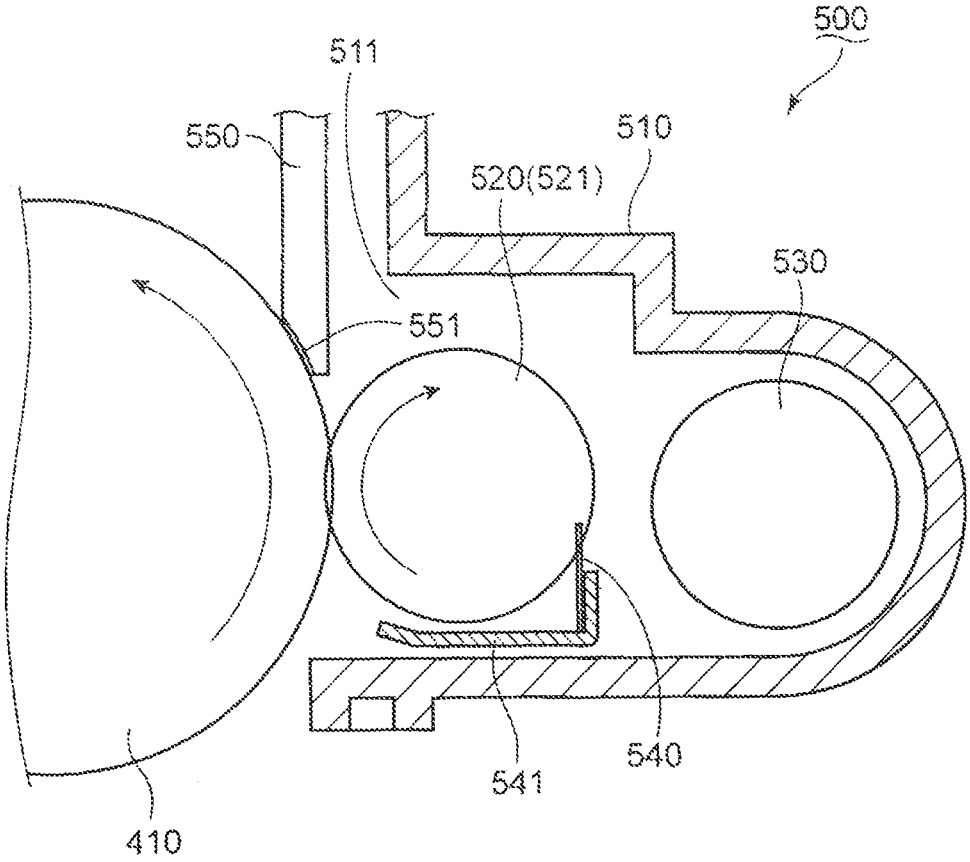
FIG. 4 is a schematic cross-sectional view of a cleaning device that cleans the photosensitive drum shown in FIG. 3.

FIG. 4 is a schematic cross-sectional view of the cleaning device 500. Cleaning of the region A will be described using FIGS. 3 and 4.

The cleaning device 500 includes a housing 510. An opening portion 511 is formed in the housing 510.

The cleaning device 500 further includes a rubbing roller 520 that is accommodated in the housing 510. The rubbing roller 520 is exposed from the housing 510 via the opening portion 511, and mainly comes into contact with the region A of the photosensitive drum 410. In the present embodiment, the velocity [m/min] of the circumferential surface of the rubbing roller 520 is set to be faster than the velocity [m/min] of the circumferential surface of the photosensitive drum 410. Alternatively, the velocity of the circumferential surface of the rubbing roller may be set to be slower than the velocity of the circumferential surface of the photosensitive drum. The rubbing roller 520 can rub the photosensitive drum 410 in accordance with the difference in velocity that is set between the rubbing roller 520 and the photosensitive drum 410, and appropriately remove the toner adhering to the region A.

In the present embodiment, the rubbing roller 520 rubs the region A, and therefore the region A is described as an example of a rubbed region. The regions B that are adjacent to the region A are described as an example of an adjacent region.

The cleaning device 500 further includes a discharge roller 530 that is accommodated in the housing 510. The rubbing roller 520 is disposed between the photosensitive drum 410 and the discharge roller 530. The rubbing roller 520 scrapes off the toner adhering to the region A. The toner scraped from the region A and adhering to the rubbing roller 520 due to rubbing by the rubbing roller 520 is conveyed to the interior of the housing 510 as the rubbing roller 520 rotates. Therefore, scattering of toner that is removed from the photosensitive drum 410 is reduced. The discharge roller 530 is used to discharge the toner that has been scraped off the region A by the rubbing roller 520 out of the housing 510. A collecting mechanism (not shown) that is capable of collecting the toner that has been directed out of the housing 510 by the rubbing roller 520 and the discharge roller 530 may have the same structure as a structure that is provided in a known cleaning device.

The cleaning device 500 includes a contact plate 540 that comes into contact with the rubbing roller 520, and a bracket 541 that holds the contact plate 540 inside the housing 510. The contact plate 540 is pressed against the circumferential surface of the rubbing roller 520. Thus, as the rubbing roller 520 rotates, the contact plate 540 can appropriately separate the toner from the rubbing roller 520. The toner that has been separated by the contact plate 540 is discharged to the outside of the housing 510 by the discharge roller 530. Accordingly, the cleaning device 500 can continuously remove the toner adhering to the photosensitive drum 410. In the present embodiment, the contact plate 540 is described as an example of a separating plate. The discharge roller 530 is described as an example of a discharge portion.

The cleaning device 500 further includes a cleaning blade 550 that abuts against the region A of the photosensitive drum 410. The housing 510 appropriately holds the cleaning blade 550 above the rubbing roller 520. The cleaning blade 550 includes a lower end portion 551 that comes into contact with the region A above a rubbing position at which the rubbing roller 520 rubs the region A of the photosensitive drum 410. That is to say, the cleaning blade 550 abuts against the region A of the photosensitive drum 410 after the rubbing roller 520. The toner still adhering to the region A after the removing process by the rubbing roller 520 is appropriately removed by the cleaning blade 550. The toner removed by the cleaning blade 550 falls onto the rubbing roller 520 by gravitation, and then directed to the interior of the housing 510 by the rubbing roller 520. Accordingly, the toner is appropriately removed from the photosensitive drum 410. In the present embodiment, the lower end portion 551 is described as an example of an abutment edge.

Cleaning Device

Figure 5:
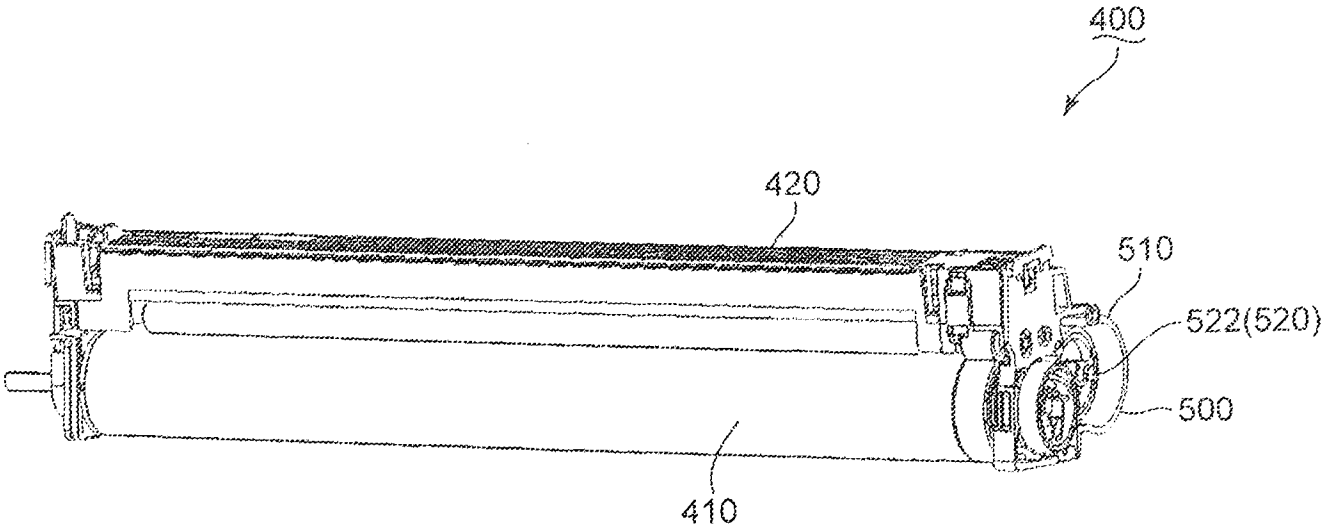
FIG. 5 is a schematic perspective view of a portion of an image forming portion of the printer shown in FIG. 2.

FIG. 5 is a schematic perspective view of a portion of the image forming portion 400. The cleaning device 500 will be described using FIGS. 4 and 5.

FIG. 5 shows the photosensitive drum 410, the charger 420 that is attached above the photosensitive drum 410, and the cleaning device 500. The rubbing roller 520 includes a cylindrical rubbing portion 521 that rubs the circumferential surface of the photosensitive drum 410, and a pair of journals 522 protruding leftward and rightward, respectively, from the rubbing portion 521. In FIG. 4, the rubbing portion 521 is shown as the rubbing roller 520. In FIG. 5, one of the journals 522 is shown as the rubbing roller 520.

The following is a description of various support brackets that can be attached to the journals 522 and can hold the rubbing roller 520 inside the housing 510. The structure of the above-described cleaning device 500 is advantageously applied to cleaning devices that will be described in connection with various embodiments below.

First Embodiment

Figure 6:
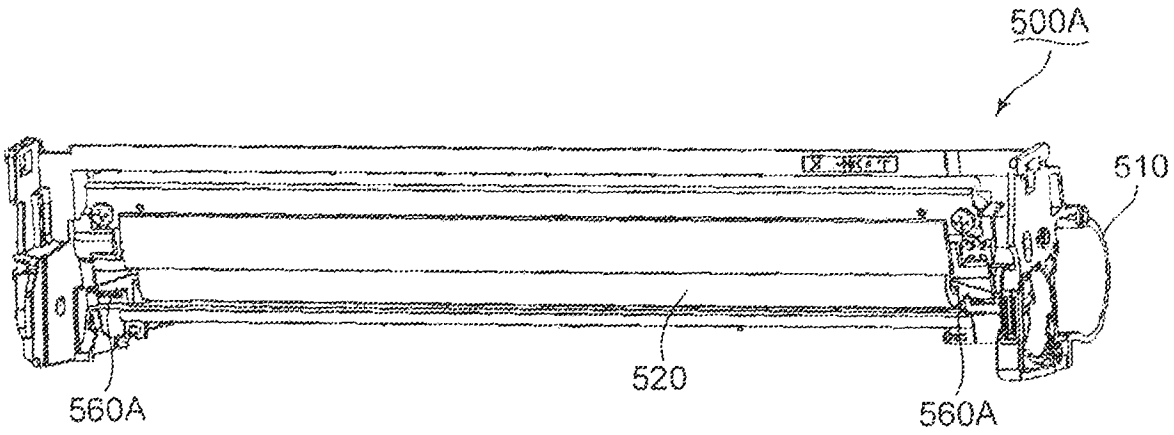
FIG. 6 is a schematic diagram showing a cleaning device according to a first embodiment of the present invention.

FIG. 6 is a schematic diagram showing a cleaning device 500A according to a first embodiment. The same components as the components of the above-described cleaning device 500 are denoted by the same reference numerals. The cleaning device 500A will be described using FIGS. 3, 5, and 6.

The cleaning device 500A includes a pair of support brackets 560A. The support brackets 560A are attached to the respective journals 522, and support the rubbing roller 520 inside the housing 510. The support brackets 560A are arranged in positions that correspond to the respective regions B, which have been described with reference to FIG. 3.

Figure 7:
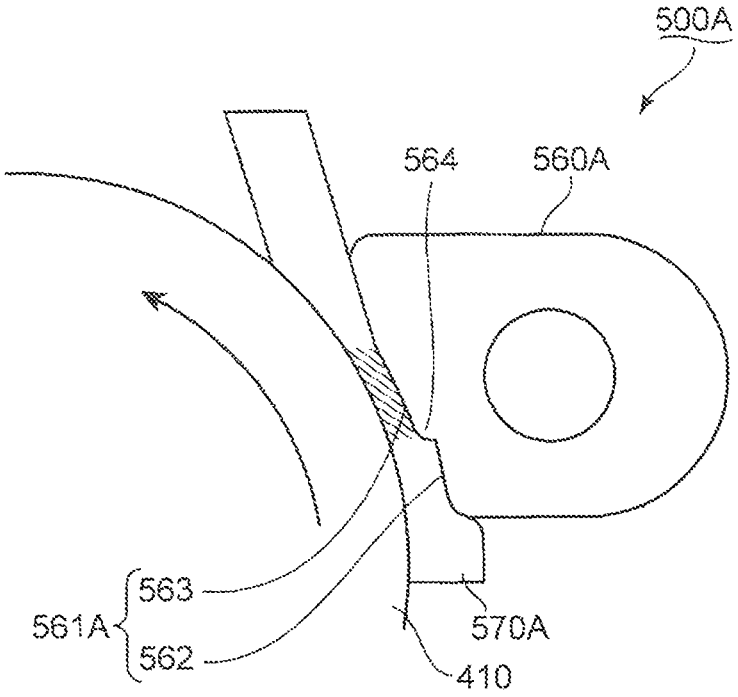
FIG. 7 is a schematic cross-sectional view of the cleaning device shown in FIG. 6.

FIG. 7 is a schematic cross-sectional view of the cleaning device 500A showing the neighborhood of a support bracket 560A. The cleaning device 500A will be further described using FIGS. 3 and 7.

The cleaning device 500A includes cleaning seals 570A that come into contact with the photosensitive drum 410. The cleaning seals 570A are pressed against the respective regions B of the photosensitive drum 410 by the support brackets 560A. The cleaning seals 570A are formed of a flexible material. The toner adhering to the regions B is appropriately removed by the cleaning seals 570A coming into contact with the regions B. In the present embodiment, the cleaning seals 570A are described as an example of a cleaning portion or a seal member. The support brackets 560A are described as an example of a pressing portion.

The support brackets 560A each include an opposing surface 561A that opposes the photosensitive drum 410. The opposing surface 561A includes a first region 562 that clamps the cleaning seal 570A from both sides in cooperation with the photosensitive drum 410, and a second region 563 that protrudes from the first region 562 toward the photosensitive drum 410. A stepped portion 564 is formed at the boundary between the first region 562 and the second region 563. In the present embodiment, the first region 562 is described as an example of a clamping surface. The second region 563 is described as an example of a protruding portion or protruding surface.

The second region 563 is closer to the region B of the photosensitive drum 410 than the first region 562. Accordingly, the cleaning seal 570A is compressed more strongly by the second region 563 than by the first region 562. In FIG. 7, that portion of the cleaning seal 570A that is compressed strongly is indicated by hatching. As shown in FIG. 7, a region that is locally strongly compressed is formed in the cleaning seal 570A, and thus the toner adhering to the region B is appropriately removed. Moreover, a driving force that can drive the photosensitive drum 410 is not excessively increased. Accordingly, an excessive increase in the driving force to the image carrier is appropriately prevented.

Figure 8:
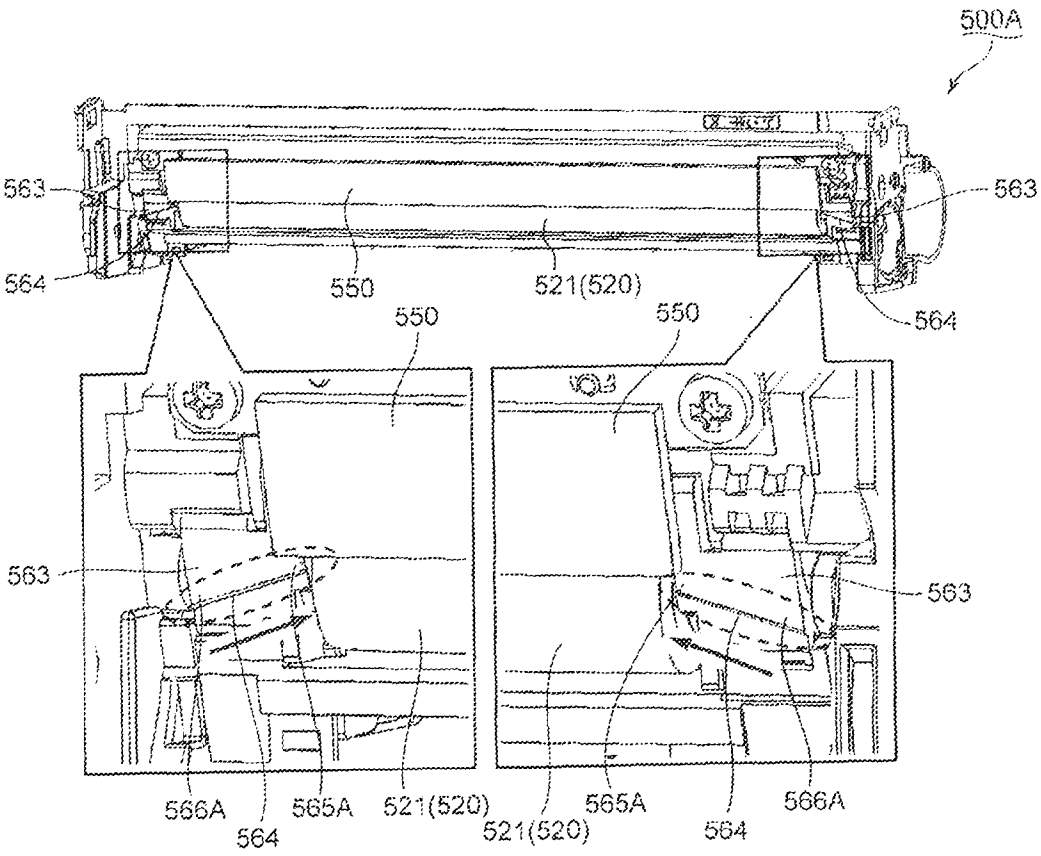
FIG. 8 shows a schematic perspective view of the cleaning device shown in FIG. 6 and enlarged perspective views of stepped portions of the cleaning device and their surroundings.

FIG. 8 shows a schematic perspective view of the cleaning device 500A and enlarged perspective views of the stepped portions 564 and their surroundings. The cleaning device 500A will be further described using FIGS. 3, 7, and 8.

A lower edge of the second region 563 that is defined by the stepped portion 564 includes an inner end portion 565A that is adjacent to the rubbing portion 521, and an outer end portion 566A that is further away from the rubbing portion 521 than the inner end portion 565A. The inner end portion 565A is located above the outer end portion 566A.

As shown in FIG. 7, the region B of the photosensitive drum 410 that comes into contact with the cleaning seal 570A moves upward. The inner end portion 565A is located downstream of the outer end portion 566A with respect to a direction in which the region B of the photosensitive drum 410 moves. Thus, the toner removed by the cleaning seal 570A is forced to move toward the region A of the photosensitive drum 410. Then, the toner adhering to the region A of the photosensitive drum 410 is removed by the rubbing roller 520 and the cleaning blade, so that the toner adhering to the photosensitive drum 410 is appropriately removed. In the present embodiment, the inner end portion 565A is described as an example of a first end portion. The outer end portion 566A is described as an example of a second end portion.

In the present embodiment, a compressing force that is applied to the cleaning seal 570A increases sharply at the stepped portion 564. Accordingly, most of the toner that has been caught by the cleaning seal 570A accumulates along the stepped portion 564. The stepped portion 564 has a contour that is inclined upward toward the inside. Thus, the toner that accumulates along the stepped portion 564 gradually moves toward the rubbing roller 520. After that, the toner is directed to the interior of the housing 510 by the rubbing roller 520 and/or the cleaning blade 550.

Second Embodiment

Figure 9:
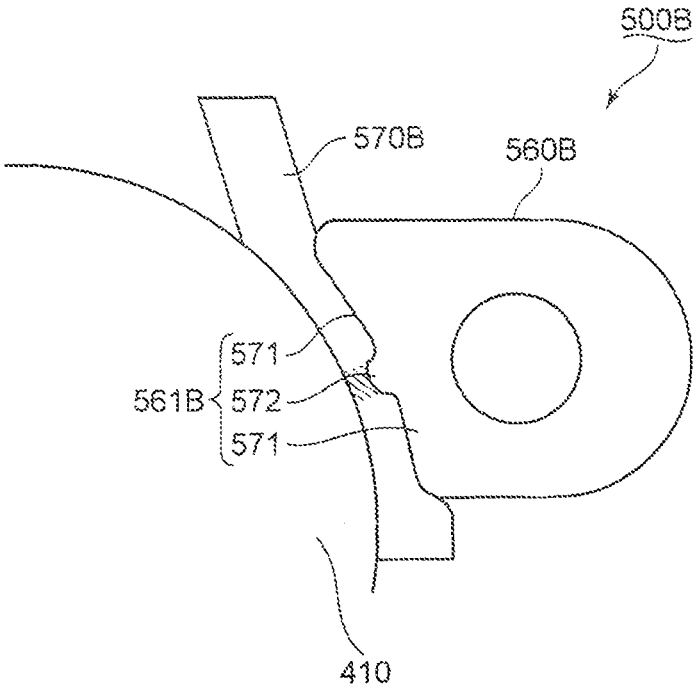
FIG. 9 is a schematic diagram showing a cleaning device according to a second embodiment of the present invention.
Figure 10:
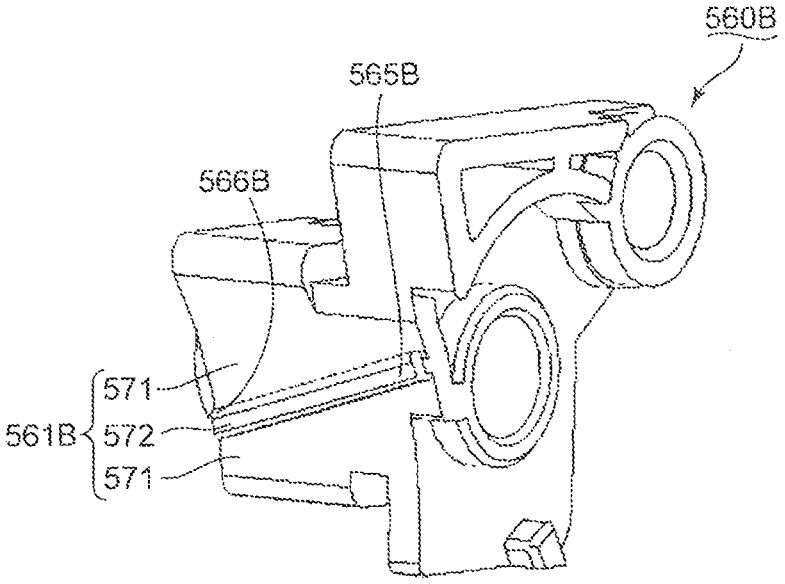
FIG. 10 is a schematic perspective view of a support bracket of the cleaning device shown in FIG. 9.

FIG. 9 is a schematic cross-sectional view of a cleaning device 500B according to a second embodiment. FIG. 10 is a schematic perspective view of one of support brackets 560B that are used instead of the support brackets 560A of the first embodiment. The cleaning device 500B will be described using FIGS. 7, 9, and 10.

The cleaning device 500B includes the support brackets 560B, and cleaning seals 570B that are disposed between the photosensitive drum 410 and the respective support brackets 560B. Each support bracket 560B includes an opposing surface 561B that opposes the circumferential surface of the photosensitive drum 410. The opposing surface 561B includes a curved surface 571 that is curved along the circumferential surface of the photosensitive drum 410, and a ridge 572 that protrudes from the curved surface 571 toward the photosensitive drum 410. A portion of the cleaning seal 570B that is situated between the ridge 572 and the photosensitive drum 410 is compressed more strongly than the other portions. In FIG. 9, the portion of the cleaning seal 570B that is compressed more strongly is indicated by hatching. A comparison between FIGS. 7 and 9 indicates that the hatched region shown in FIG. 9 is narrower than the hatched region shown in FIG. 7. That is to say, the ridge 572 produces a high pressing force in a narrow region of the cleaning seal 570B. Accordingly, the cleaning device 500B according to the second embodiment does not excessively increase the driving force for the photosensitive drum 410. Thus, the cleaning device 500B enables the cleaning seal 570B to be pressed against the photosensitive drum 410 with a relatively strong force. In the present embodiment, the ridge 572 is described as an example of the protruding portion. The curved surface 571 is described as an example of the clamping surface. The cleaning seal 570B is described as an example of the cleaning portion.

The ridge 572 includes an inner end portion 565B and an outer end portion 566B. As in the case of the first embodiment, the inner end portion 565B is located above the outer end portion 566B. Moreover, the inner end portion 565B is located downstream of the outer end portion 566B with respect to the direction in which the region B of the photosensitive drum 410 moves. Accordingly, according to the principle that has been described in connection with the first embodiment, the toner that has been caught by the ridge 572 moves toward the inner end portion 565B.

In the foregoing embodiments, the photosensitive drum 410 is described as an example of the image carrier. Alternatively, the principles of the foregoing embodiments may also be applied to cleaning of other image carriers that have an image carrying surface on which a toner image is carried.

In the foregoing embodiments, the cleaning seals 570A and 570B are described as examples of the cleaning portion. Any material that can deform in accordance of the shape of the opposing surfaces 561A and 561B and transmit the pressure caused by the deformation to the photosensitive drum 410 and/or other image carriers can be advantageously used for the cleaning seals 570A and 570B.

In the foregoing embodiments, the support brackets 560A and 560B are described as examples of the pressing portion. Alternatively, other members that can locally deform the cleaning seals 570A or 570B and apply a locally high pressure to the photosensitive drum 410 and/or other image carriers may also be used as the pressing portion.

It is to be understood that the embodiments herein are illustrative and not restrictive, since the scope of this disclosure is defined by the appended claims rather than by the description preceding them, and all changes that fall within metes and bounds of the claims, or equivalence of such metes and bounds thereof are therefore intended to be embraced by the claims.

The invention claimed is:

1. A cleaning device comprising:

a cleaning seal that comes into contact with an image carrier that is adapted to carry a toner image;

a rubbing roller that rubs the image carrier;

a support bracket that includes a clamping surface and a protruding surface and supports the rubbing roller, the clamping surface clamping the cleaning seal from both sides in cooperation with the image carrier, the protruding surface protruding from the clamping surface toward the image carrier and pressing the cleaning seal against the image carrier; and a cleaning blade including an abutment edge that abuts against the image carrier after the rubbing roller relative to the rotational direction of the rubbing roller, wherein the image carrier includes a rubbed region and an adjacent region, the rubbed region being rubbed by the rubbing roller, the adjacent region being adjacent to the rubbed region, the support bracket allows the protruding surface to press the cleaning seal against the adjacent region of the image carrier, and the protruding surface includes a projection formed at a boundary of the clamping surface and the protruding surface that is further away from the rubbing roller than the clamping surface.

2. The cleaning device according to claim 1, wherein the abutment edge is located above a position at which the rubbing roller rubs the image carrier.

3. The cleaning device according to claim 2, further comprising a housing that accommodates the rubbing roller, wherein the rubbing roller that comes into contact with the rubbed region via an opening portion formed in the housing conveys toner removed from the rubbed region and adhering to the rubbing roller to the interior of the housing.

4. The cleaning device according to claim 3, further comprising:

a separating plate that separates the toner from the rubbing roller, and a discharge portion that discharges the toner separated by the separating plate out of the housing.

5. The cleaning device according to claim 1, wherein the protruding surface is closer to the image carrier than the clamping surface.

6. The cleaning device according to claim 1, wherein the protruding surface locally deforms the cleaning seal.

7. An image forming apparatus comprising:

an image carrier that is adapted to carry a toner image;

a cleaning seal that comes into contact with the image carrier;

a rubbing roller that rubs the image carrier;

a support bracket that includes a clamping surface and a protruding surface and supports the rubbing roller, the clamping surface clamping the cleaning seal from both sides in cooperation with the image carrier, the protruding surface protruding from the clamping surface toward the image carrier and pressing the cleaning seal against the image carrier; and a cleaning blade including an abutment edge that abuts against the image carrier after the rubbing roller relative to the rotational direction of the rubbing roller, wherein the image carrier includes rubbed region and an adjacent region, the rubbed region being rubbed by the rubbing roller, the adjacent region being adjacent to the rubbed region, the support bracket allows the protruding surface to press the cleaning seal against the adjacent region of the image carrier, and the protruding surface includes a projection formed at the boundary of the clamping surface and the protruding surface that is further away from the rubbing roller than the clamping surface.

8. The image forming apparatus according to claim 7, wherein the abutment edge is located above a position at which the rubbing roller rubs the image carrier.

9. The image forming apparatus according to claim 8, further comprising a housing that accommodates the rubbing roller, wherein the rubbing roller that comes into contact with the rubbed region via an opening portion formed in the housing conveys toner removed from the rubbed region and adhering to the rubbing roller to the interior of the housing.

10. The image forming apparatus according to claim 9, further comprising:

a separating plate that separates the toner from the rubbing roller, and a discharge portion that discharges the toner separated by the separating plate out of the housing.

11. The image forming apparatus according to claim 7, wherein the protruding surface is closer to the image carrier than the clamping surface.

12. The image forming apparatus according to claim 7, wherein the protruding surface locally deforms the cleaning seal.

* * * * *